US008544124B2

(12) United States Patent
Yoon

(10) Patent No.: US 8,544,124 B2
(45) Date of Patent: Oct. 1, 2013

(54) TURNING APPARATUS FOR MULTIPURPOSE SPACE UTILIZATION FURNITURE

(76) Inventor: Choon Bae Yoon, Seoul (KR)

( * ) Notice: Subject to any disclaimer, the term of this patent is extended or adjusted under 35 U.S.C. 154(b) by 43 days.

(21) Appl. No.: 13/060,273

(22) PCT Filed: Aug. 20, 2009

(86) PCT No.: PCT/KR2009/004626
§ 371 (c)(1),
(2), (4) Date: Feb. 22, 2011

(87) PCT Pub. No.: WO2010/021494
PCT Pub. Date: Feb. 25, 2010

(65) Prior Publication Data

US 2011/0145990 A1 Jun. 23, 2011

(30) Foreign Application Priority Data

Aug. 22, 2008 (KR) ..... 10-2008-0082251

(51) Int. Cl.
*A47C 17/62* (2006.01)

(52) U.S. Cl.
USPC ..... 5/3; 5/2.1

(58) Field of Classification Search
USPC ..... 5/3, 2.1, 5, 9.1
See application file for complete search history.

(56) References Cited

U.S. PATENT DOCUMENTS

| | | | | |
|---|---|---|---|---|
| 246,082 | A * | 8/1881 | Coffin | 105/322 |
| 544,982 | A * | 8/1895 | Hoskins | 297/62 |
| 737,561 | A * | 9/1903 | Arnold | 5/9.1 |
| 2,550,599 | A * | 4/1951 | Reed | 5/9.1 |
| 2,854,672 | A * | 10/1958 | Hagstrom | 5/9.1 |
| 3,311,932 | A * | 4/1967 | Ahola | 5/9.1 |
| 3,811,138 | A * | 5/1974 | Del Missier | 5/9.1 |
| 7,543,340 | B2 * | 6/2009 | Kenny et al. | 5/9.1 |
| 2007/0294822 | A1 * | 12/2007 | Kenny et al. | 5/9.1 |
| 2011/0145990 | A1 * | 6/2011 | Yoon | 5/3 |

FOREIGN PATENT DOCUMENTS

| | | |
|---|---|---|
| KR | 10-20000024147 | 5/2000 |
| KR | 20-0296947 | 11/2002 |
| KR | 10-0669365 | 1/2007 |
| KR | 10-0824077 | 4/2008 |

OTHER PUBLICATIONS

International Search Report for PCT/KR2009/004626 mailed Apr. 22, 2010.

* cited by examiner

*Primary Examiner* — Robert G Santos
(74) *Attorney, Agent, or Firm* — Christopher Paul Mitchell

(57) ABSTRACT

The present invention relates to multipurpose furniture which combines a bed and a desk, and is positioned between furniture facing each other. Since a turning apparatus for the multipurpose furniture is simplified, there is a reduction in all kinds of work processes and the work load required for turning of a turning member, of which a table surface and a mattress respectively used as a desk and a bed are formed on top and bottom, and manufacturing cost is decreased. In addition, when the multipurpose furniture is used as a bed, stability during sleep is increased and sleeping in comfort is doubled through minimization of the height from the surface.

4 Claims, 5 Drawing Sheets

TURNING APPARATUS FOR MULTIPURPOSE SPACE UTILIZATION FURNITURE

RELATED APPLICATIONS

This application is a 371 application of International Application No. PCT/KR2009/004626, filed Aug. 20, 2009, which in turn claims priority from Korean Patent Application No. 10-2008-0082251, filed Aug. 22, 2008, each of which is incorporated herein by reference in its entirety.

TECHNICAL FIELD

The present invention relates to a multipurpose furniture combining a bed and a desk, in particular, to a turning apparatus for a multipurpose space utilization furniture which can enhance operation convenience of the multipurpose furniture and decrease manufacturing cost.

BACKGROUND ART

In general, the multipurpose furniture is a kind of furniture which is developed for the purpose of utilizing narrow indoor space by combining a bed and a desk, and in such a multipurpose furniture, a turning member having a mattress surface and a table surface is mounted between the furnitures, and the turning member is selectively used as a desk or a bed as needed.

Namely, according to the "multipurpose furniture (Registration No. 10-0395475)" proposed by the applicant, it is comprised of a pair of supporting means (300) including a chest of drawers, and a turning member (100) which is disposed between the supporting means (300) and can be turned by a actuator (200) and is supported by supporting members (330), as shown in FIG. 1.

Further, the turning member (100) can be turned by co-operation of shaft receivers (221) formed in the supporting means (300) and turning shafts (211) formed in the turning member (100), and be kept in horizontal state by co-operation of horizontal supporting member (325) and connecting strings (326) arranged in the supporting member (330), as shown in FIG. 2.

By the way, since in the above-mentioned multipurpose furniture (1) the turning member (100) is kept in its supported state through the supporting member (330) while turned by the actuator (200), such problems are present that operation structure of the turning member (100) is complex, thus operation process and operation load are increased and manufacturing cost is also increased.

Further, since the multipurpose furniture (1) has a structure of the turning being made about the turning shaft (211) of the actuator (200), there are concerns that when the turning member (100) is used as a mattress, its height from ground surface is too high and is easily movable by external force, thus such problem is present that it is difficult to provide comfort in sleep to users.

DISCLOSURE OF THE INVENTION

Problem to be Solved by the Invention

The present invention is devised to solve the above-mentioned problems, and its object is to provide a turning apparatus for multipurpose space utilization furniture which can enhance operation convenience of the turning member and decrease manufacturing cost by changing the turning structure of the multipurpose furniture.

Means for Solving the Problem

In order to achieve the above-mentioned object, the present invention comprises a plurality of fixed legs which are mounted side by side on inner wall surfaces of the furnitures along the up-and-down direction and on inner surfaces of which upper and lower engagement holes and support projections are formed, respectively; fixed plates which are mounted on the both side surfaces of the turning member, respectively and on outer wall surface of which support shafts having respective bearings are mounted in position corresponding to the upper engagement hole and the lower engagement hole; and locking rings which are slidably mounted in the support shafts of the fixed plates, respectively and selectively engage with or are released from the upper engagement hole or the lower engagement hole in the process of fixing of the turning member.

BEST MODE FOR CARRYING OUT THE INVENTION

Hereinbelow, an example according to the present invention is described as follows.

Figure 1:
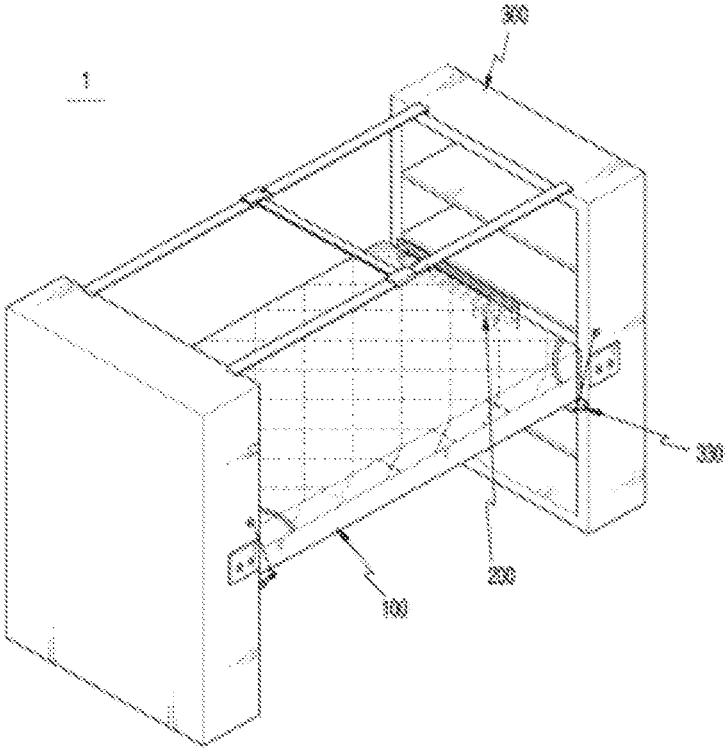
Fig. 1 (Background Art)
FIG. 1 is a perspective view illustrating a multipurpose furniture according to the prior art.
Figure 2:
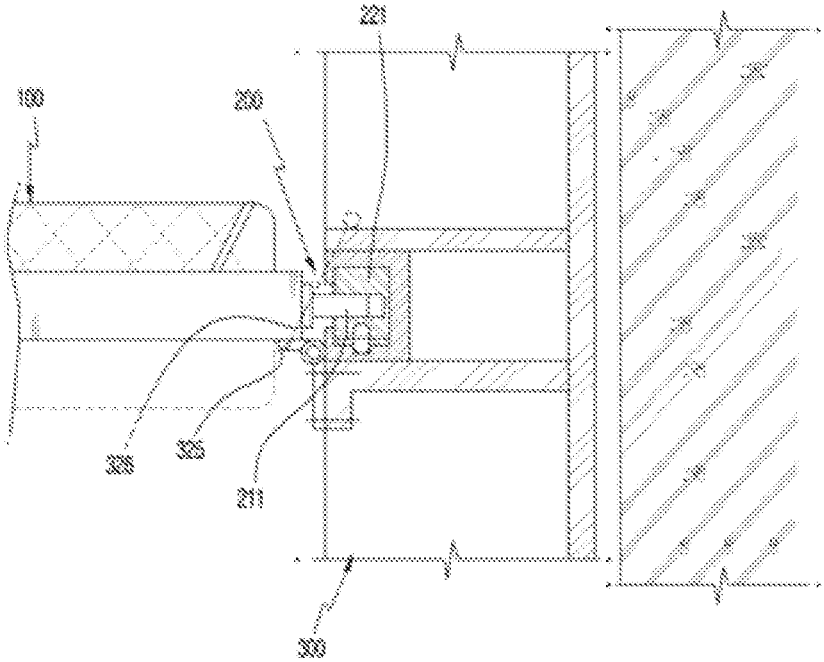
Fig. 2 (Background Art)
FIG. 2 is a front sectional view of FIG. 1 with a part thereof being omitted.
Figure 3:
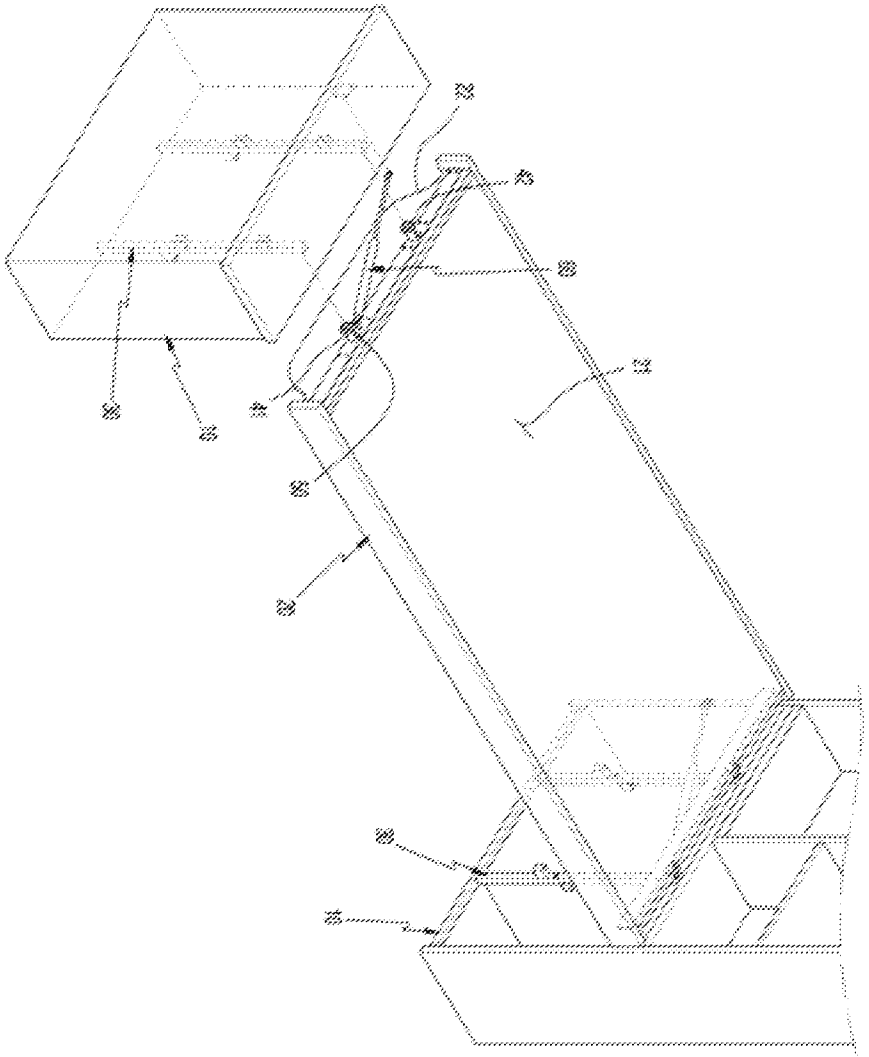
FIG. 3 shows an example illustrating a multipurpose furniture according to the present invention.
Figure 4:
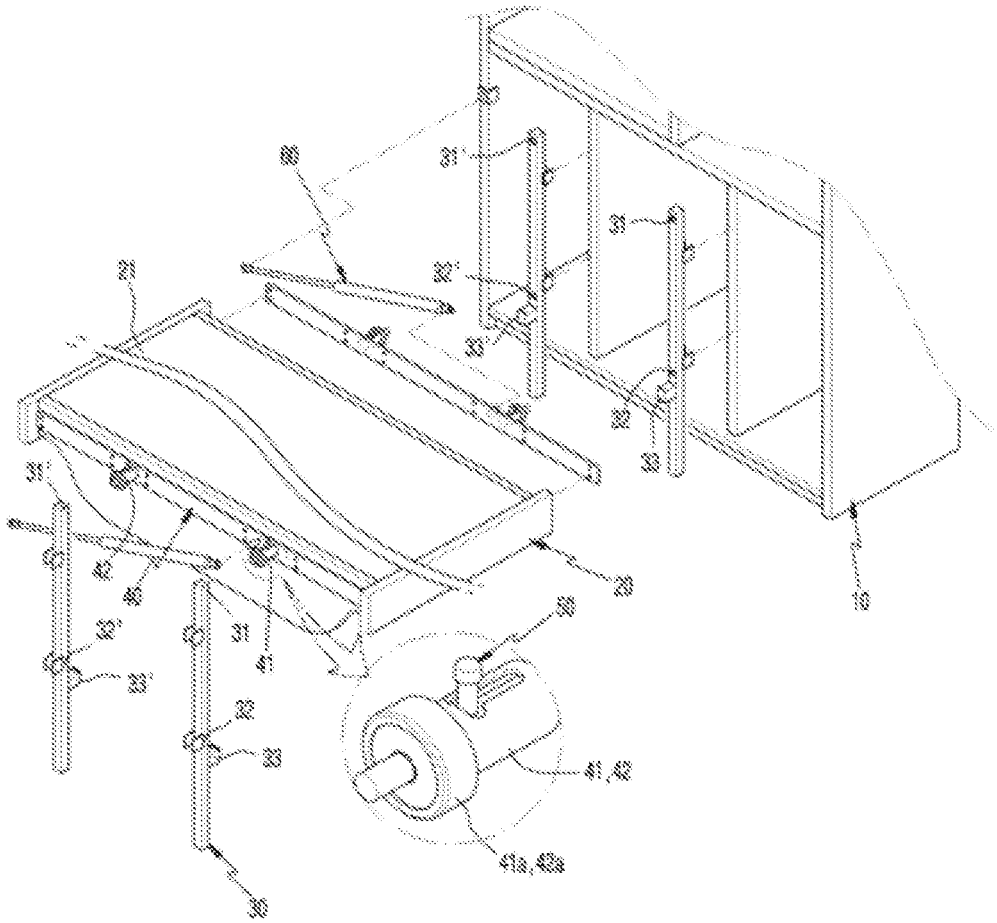
FIG. 4 is a exploded perspective view illustrating a turning apparatus for the multipurpose furniture according to the present invention.

FIG. 3 shows an example illustrating the multipurpose furniture according to the present invention, FIG. 4 is a exploded perspective view illustrating the turning apparatus of the multipurpose furniture according to the present invention, and FIGS. 5 to 9 are sectional views illustrating operation process of the multipurpose furniture according to the present invention.

The turning apparatus for the turning member (20) which is disposed between furnitures (10) and in which a table surface (21) and a mattress surface (22) are formed on top and bottom side thereof, respectively comprises a plurality of fixed legs (30) which are mounted side by side on inner wall surfaces of the furnitures (10) along the up-and-down direction and on inner surfaces of which upper and lower engagement holes (31, 32) and support projections (33) are formed, respectively; fixed plates (40) which are mounted on the both side surfaces of the turning member (20), respectively and on outer wall surface of which support shafts (41, 42) having respective bearings (41*a*, 42*a*) are mounted in position corresponding to the upper engagement hole (31) and the lower engagement hole (32); and locking rings (50) which are slidably mounted in the support shafts (41, 42) of the fixed plates (40), respectively and selectively engage with or are released from the upper engagement hole (31) or the lower engagement hole (32) in the process of fixing of the turning member (20), and the turning member (20) is set as the table surface (21) or the mattress surface (22) by fixing the turning member with the locking rings (50) while the support shafts (41 or 42) provided in the turning member (20) are selectively fitted in the upper engagement hole (31) or the lower engagement hole (32) formed in the fixed legs (30).

Here, the turning apparatus of the present invention is one for turning the turning member (20) mounted between the furnitures (10), and is characterized in that it comprises a plurality of fixed legs (30) fixed on one side surface or inner wall surface of the furniture (10); fixed plates (40) mounted on the both side surfaces of the turning member (20); respective locking rings (50) housed in the support shafts (41, 42) of the fixed plates (40); and shock-absorbing means (60) connecting the furniture (10) with the turning member (20).

At this point, the furnitures (10) are arranged with a distance corresponding to total length of the turning member (20), and may be a chest of drawers or a monitor carrier, but is not limited to them, and in particular, when one of the furnitures (10) is constructed as the monitor carrier, it is desirable to utilize space by making its upper plate slidable.

Further, the turning member (20) is fixed with the locking rings (50) while positioned horizontally between the furnitures (10), and is shown restrictively to be formed with a table surface (21) used as a desk and a mattress surface (22) used as a bed, but all furnitures combining another functions are naturally included.

Further, the fixed legs (30) are mounted side by side on the both inner wall surfaces of the furnitures (10) with a constant distance and the upper engagement hole (31) and the lower engagement hole (32) are formed with a constant distance on the inner surfaces of the fixed legs (30), and on the lower side of the lower engagement hole (32) is formed support projections (33) on which the support shafts (41, 42) described hereinafter are seated.

At this point, it is desirable that the fixed legs (30) are made of metal material or reinforced plastic material having a strength enough to support the load of the turning member (20) itself, the weight of the user and total load of the objects to be carried, and in particular it is desirable to make its appearance in a rectangular shape so as to increase supporting strength.

Further, the fixed plates (40) are plate-like members mounted on the both side surfaces of the turning member (20), respectively and a pair of right and left engagement holes, in which the support shafts (41, 42) described hereinafter are mounted, are formed on the both side portions of the fixed plates, and between the right and left engagement holes are formed engagement holes (45) in which the shock-absorbing means (60) described hereinafter is mounted.

At this point, it is desirable that arrangement distance in the right-and-left direction of the support shafts (41, 42) is identical to the distance with which the upper engagement holes (31) and the lower engagement hole (32) are spaced in the up-and-down direction, and in particular it is desirable to mount respective bearings (41*a*, 42*a*) on the tip parts of the support shafts, which bearings provide turning force in one direction or in the both directions in the process of contacting with the support projections (33).

In particular, it is desirable to form sliding grooves in the support shafts (41, 42) along the longitudinal direction, in which grooves locking rings (50) described hereinafter are reciprocally movable.

At this point, in the present application, although the description is limited to the case that the fixed plates (40) having the support shafts (41, 42) are mounted on the both side surfaces of the turning member (20), even such case is naturally included in the scope of the present invention that the support shafts (41, 42) are mounted directly on the both side surfaces of the turning member (20) with the fixed plates (40) omitted.

Further, the locking rings (50) are housed in the support shafts (41, 42) respectively so as to be received and withdrawn in forward and backward sliding manner and selectively engage with or are released from the upper engagement hole (31) or the lower engagement hole (32), and in particular it is desirable that the locking rings are constructed to be always biased outward by a spring interposed on a side portion thereof.

Of course, the locking rings (50) consist of a bar-like movable part which is fitted into the upper engagement hole (31) or the lower engagement hole (32) while slidingly moved inside the support shafts (41, 42), and a handle part which is formed integral with the movable part and perpendicular thereto and held by a user's hand.

Further, it is desirable to mount one or more shock-absorbing means (60) on the inner wall surfaces of the furnitures (10) and in engagement holes (45) of the fixed plates (40), which shock-absorbing means absorbs the load of the turning member (20) itself occurring in the process of turning of it so as to absorb shock.

At this point, it is desirable to design the shock-absorbing means (60) with consideration of total load and turning speed of the turning member (20), and in particular it is desirable to use gas spring, coil spring or leaf spring and the like for the shock-absorbing means, but it is not limited to them.

Hereinbelow, the operation according to the present invention is described in detail with reference to the attached FIGS. 4 and 5 as follows.

Figure 5:
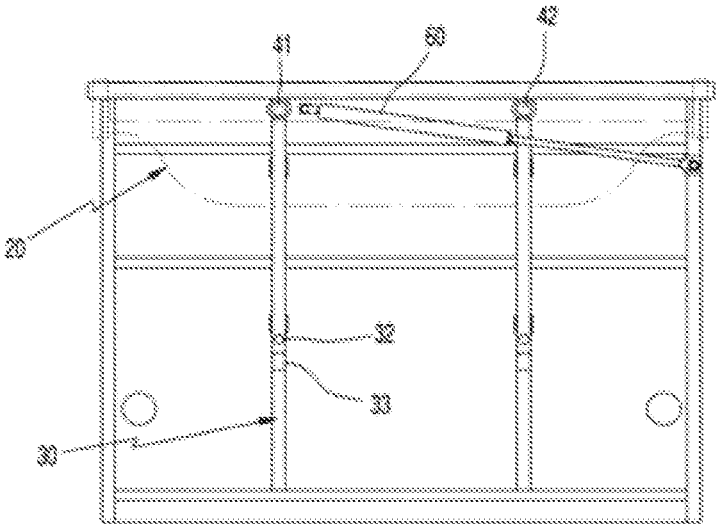
FIGS. 5 to 9 are sectional views illustrating operation process of the multipurpose furniture according to the present invention.

Here, in the description of the operation structure of the present invention, constituents (31, 32, 33) of the fixed legs (30) are differently designated with reference numerals, namely with reference numerals "31, 32, 33" for front side of the drawing and with reference numerals "31', 32', 33'" for rear side of the drawing, as shown in FIGS. 4 and 5.

For the moment, in the multipurpose furniture according to the present invention, the table surface (21) is used as a desk when the table surface (21) faces upward in the case that the turning member (20) is arranged between the furnitures (10), as shown in FIG. 5.

Figure 6:
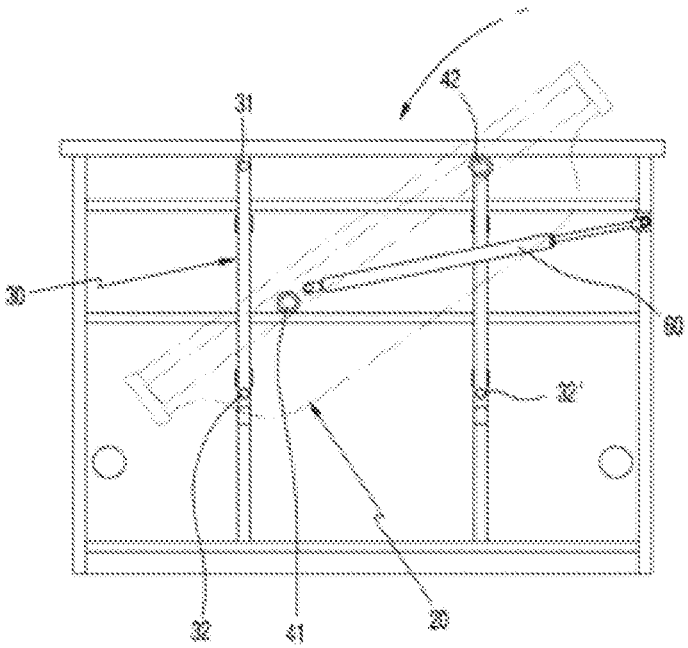

When the multipurpose furniture is to be coverted to a bed, once the locking ring (50) fitted in the upper engagement hole (31) of the fixed leg (30) is pulled and released, thereby front end portion of the turning member (20) is made to be in the state of being able to be turned counterclockwise, as shown in FIG. 6.

At this point, in the process of the turning member (20) being turned counterclockwise, the load of the turning member (20) itself is absorbed by the shock-absorbing means (60) integrated between the furniture (10) and the turning member (20), thus consecutive turning is made possible.

Of course, it is needless to say in the present invention that the release of the locking ring (50) fitted in the upper engagement hole (31) of the fixed leg (30) means the release of all the locking rings (50) arranged on the both sides of the turning member (20).

Figure 7:
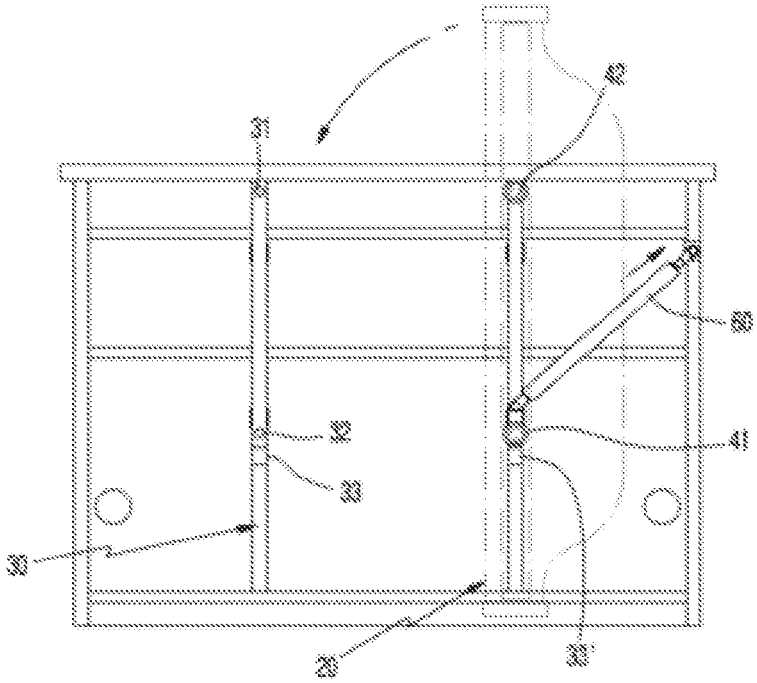

Next, the locking ring (50) arranged in the support shaft (41) of the fixed plate (40) is fitted into the lower engagement hole (32') and fixed when the support shaft (41) is seated on support projection (33') in the process of turning of the turning member (20), as shown in FIG. 7.

Figure 8:
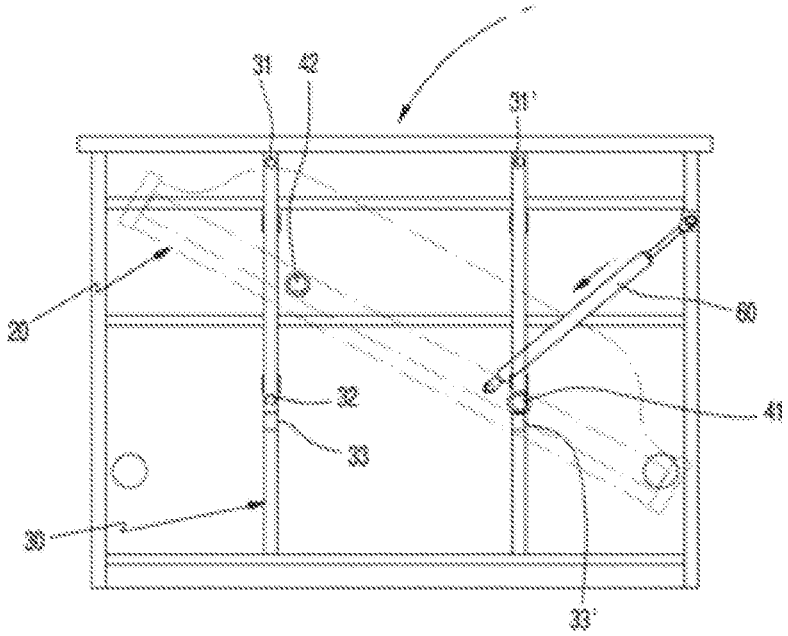

Next, if the locking ring (50) fitted in the upper engagement hole (31') of the fixed leg (30) is pulled and released, rear end portion of the turning member (20) is made to be in the state of being able to be turned counterclockwise, as shown in FIG. 8.

Figure 9:
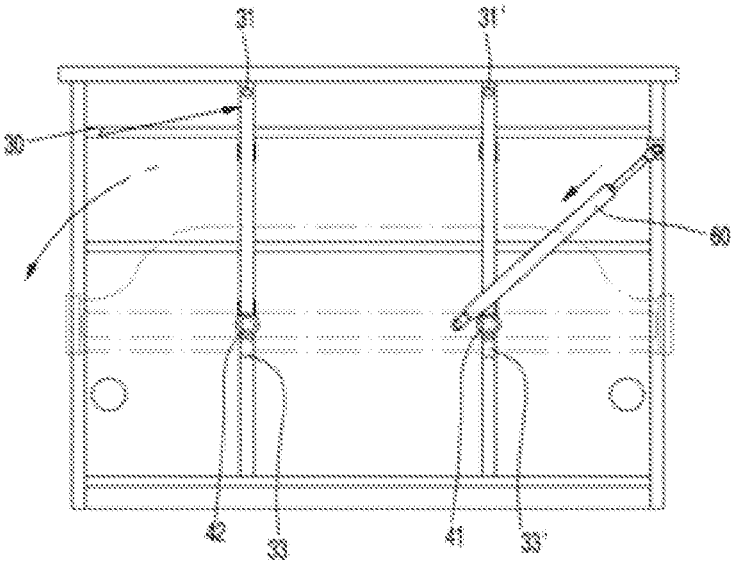

Next, the locking ring (50) arranged in the support shaft (42) of the fixed plate (40) is fitted into the lower engagement hole (32) and fixed when the support shaft (42) is seated on support projection (33) in the process of turning of the turning member (20), as shown in FIG. 9.

In this way, with the turning member (20) being fixed with the locking rings (50) while being seated on the support projections (33, 33') of the fixed legs (30), the mattress surface (22) faces upward, thus the turning member (20) can be used as a bed.

Industrial Applicability

The turning apparatus for multipurpose space utilization furniture according the present invention as described above gives the effects as follows.

First, the turning apparatus for the multipurpose furniture is simplified, thus various operation process and operation load associated with the turning of the turning member are decreased and manufacturing cost is also decreased.

Second, since the height from ground surface is minimized when the multipurpose furniture is used as a bed, stability in sleep is enhanced and the comfort in sleep is doubled.

The invention claimed is:

1. A turning apparatus for the multipurpose space utilization furniture, the turning apparatus being one for a turning member which is disposed between furnitures and in which a table surface and a mattress surface are formed on top and bottom side thereof, respectively, characterized in that the turning apparatus comprising:

a plurality of fixed legs which are mounted side by side on one side surface of the furnitures with a constant distance along the up-and-down direction and in which upper and lower engagement holes are formed with a constant distance in the up-and-down direction, and in which support projections are formed directly below the lower engagement holes;

fixed plates which are mounted on the opposite side surfaces of the turning member, respectively and have support shafts arranged in the right-and-left direction with the same distance as distance between the upper engagement hole and the lower engagement hole; and locking rings which are housed in the support shafts of the fixed plate respectively so as to be received and withdrawn in forward and backward sliding manner and selectively engage with or are released from the upper engagement hole or the lower engagement hole in the process of fixing of the turning member, the turning member is set as the table surface or the mattress surface by fixing the turning member with the locking rings while the support shafts provided in the turning member are selectively fitted in the upper engagement hole or the lower engagement hole formed in the fixed legs.

2. The turning apparatus for the multipurpose space utilization furniture according to claim 1, characterized in that at least one shock-absorbing means are mounted on one side surface of the furniture which absorbs the load of the turning member itself occurring in the process of turning of it.

3. The turning apparatus for the multipurpose space utilization furniture according to claim 1, characterized in that bearings are mounted on the tip parts of the support shafts for providing smooth turning force when the support shafts contact with the support projections in the process of turning of the turning member.

4. The turning apparatus for the multipurpose space utilization furniture according to claim 1, characterized in that the locking rings consist of a bar-shaped movable part which is fitted into the upper engagement hole or the lower engagement hole while slidingly moved in forward and backward direction inside the support shafts, and a handle part which is formed integral with the movable part and perpendicular thereto and move the movable part in forward and backward direction, and a spring is arranged on one end portion of the movable part by which the movable part is always biased forward.

* * * * *